US006149281A

United States Patent [19]

Harruff et al.

[11] Patent Number: 6,149,281

[45] Date of Patent: Nov. 21, 2000

[54] NEON LIGHTING FIXTURE

[75] Inventors: Robert J Harruff, Pewaukee; Philip R Gross, Brookfield, both of Wis.

[73] Assignee: Everbrite, Inc., Greenfield, Wis.

[21] Appl. No.: 09/060,946

[22] Filed: Apr. 15, 1998

[51] Int. Cl.[7] ..... F21S 3/00

[52] U.S. Cl. ..... 362/223; 362/221; 362/216; 362/362

[58] Field of Search ..... 362/216, 217, 362/221, 222, 223, 362

[56] References Cited

U.S. PATENT DOCUMENTS

| | | | |
|---|---|---|---|
| 2,269,182 | 1/1942 | Claspy et al. . | |
| 4,482,941 | 11/1984 | Lindner | 362/223 X |
| 5,001,613 | 3/1991 | Foster et al. | 362/223 |
| 5,025,355 | 6/1991 | Harwood | 362/147 |
| 5,124,896 | 6/1992 | Bentley | 362/223 |
| 5,209,674 | 5/1993 | Foster et al. . | |
| 5,455,755 | 10/1995 | Brandy | 362/223 X |
| 5,471,372 | 11/1995 | Mamelson et al. | 362/223 X |
| 5,499,170 | 3/1996 | Gagne | 362/223 |
| 5,541,823 | 7/1996 | Fallon et al. | 362/219 |
| 5,658,067 | 8/1997 | Engle et al. | 362/222 |
| 5,765,944 | 6/1998 | Fallon et al. | 362/359 |

FOREIGN PATENT DOCUMENTS

| | | |
|---|---|---|
| 291891 | 7/1965 | Netherlands . |
| 477650 | 10/1969 | Switzerland . |

*Primary Examiner*—Laura K. Tso
*Attorney, Agent, or Firm*—Ryan Kromholz & Manion

[57] ABSTRACT

A neon lighting fixture has a first housing channel member that mounts to a building wall and has side walls terminating in rims on opposite sides of the open side of the member. A second inverted housing channel member has a neon tube supporting wall and side walls that are spaced apart to define an open side which interfaces with the open side of the first channel member. There are cooperating elements on the side walls of each member. An electric power supply assembly is mounted to the second nominally inverted channel member between its side walls and is supported on ledges in the side walls. A neon tube mounts on the second channel member's tube supporting wall on which wall there are spaced apart grooved rails that serve as slides. A light transmissive cover has slides shaped complementarily to the grooves in dove-tail fashion to provide for interlocking the cover to the second housing channel member by sliding the cover onto the member endwise of the grooves.

7 Claims, 3 Drawing Sheets

NEON LIGHTING FIXTURE

BACKGROUND OF THE INVENTION

The invention disclosed herein pertains to a fixture that utilizes glass tubing containing an electrically ionizable inert gas or vapor, such as neon or mercury vapor, that is excited to fluoresce when an electrical potential is applied to the tubing. The fixture may be used as a source of illumination or for decorative purposes indoors or outdoors although it is designed for withstanding inclement weather when mounted on the outside of a building. The word "neon" is used herein as a generic designation of all suitable ionizable luminous gases and vapors.

An example of the art to which the invention described herein pertains is given in U.S. Pat. No. 5,541,823, issued Jul. 30, 1996. The cited patent discloses one type of fixture housing that is comprised of three longitudinally extending channel members, at least one of which is a transparent member to provide for light emitted from the glass tubing to be visualized directly or to provide for illuminating a building and/or the environment adjacent a building. In the patent, the neon tubing, its supporting standoffs, and a transformer are mounted to a plastic plate that slides into the grooves in one of the channel members and constitutes a fourth separate piece of the housing assembly besides the three channels.

SUMMARY OF THE INVENTION

An objective of the invention disclosed herein is to be provide a neon lighting fixture that is constructed with a minimum of parts and is distinguished by being designed for allowing the majority of its components to be pre-assembled in the factory so that when one channel, constituting a wiring raceway, is mounted to a building by the installers the pre-assembly can be pressed onto the channel to effect interlocking followed by plugging electrical connectors together to put the fixture in readiness for operation.

Some, if not most, of the prior neon lighting fixtures of the type under consideration are connected to low voltage direct current parallel power supply lines which run from fixture-to fixture. The neon tubes in each fixture must be energized with relatively high alternating voltage such as, for example, 500 volts or more. Hence, the direct current supply must be inverted to AC and transformed to high voltage. A disadvantage of using a DC low voltage supply is that care must be taken to maintain the same polarity at the polarized infeed terminals of the power supply in each fixture.

Hence, another objective of the invention disclosed herein is to provide neon lighting fixtures that are energized from low voltage alternating current supply lines that run from fixture-to-fixture without needing polarized connectors between fixtures and without having to be concerned about the polarity of lines that are tapped off the low voltage alternating current supply lines.

According to the invention, the fixture housing is composed of three major members. One is a channel-like member constituting both a raceway and base support which has a bottom for fastening it to a fixed support such as a building and has parallel sides integral with the bottom and defining the lateral margins of the channel. A second housing member of the three is comparable to an inverted channel whose closed bottom constitutes a top surface and has sidewalls that are configured for interlocking with the sidewalls of the raceway channel and is configured for containing a voltage and frequency step up electronic power supply.

The third member of the housing is a transparent cover and is configured as a unshaped member having sidewalls terminating in a form for suitably interlocking with the intermediate or second power supply containing member of the housing. The neon tube is mounted to the second member and extends longitudinally thereof. The high voltage and high frequency electronic power supply for the neon tube is in a container member having laterally spaced apart sidewalls, a bottom and an open top to provide for installing the power supply container in a space between the sidewalls of the second housing member. The container occupied by the power supply is wired and assembled at the factory so that all that is necessary to install one or more fixtures in the field is to have workmen with common skills mount the base channel or raceway on a wall, for example, then interlock the pre-assembly comprised of the inverted second channel member and the translucent or transparent cover member that protects the neon tube against damage that might result if it were impacted.

How the foregoing features and objectives of the invention are achieved and implemented will appear in the ensuing more detail description of a preferred embodiment of the invention which will now be set forth in reference of the accompanying drawings.

DESCRIPTION OF PREFERRED EMBODIMENT

Figure 1:
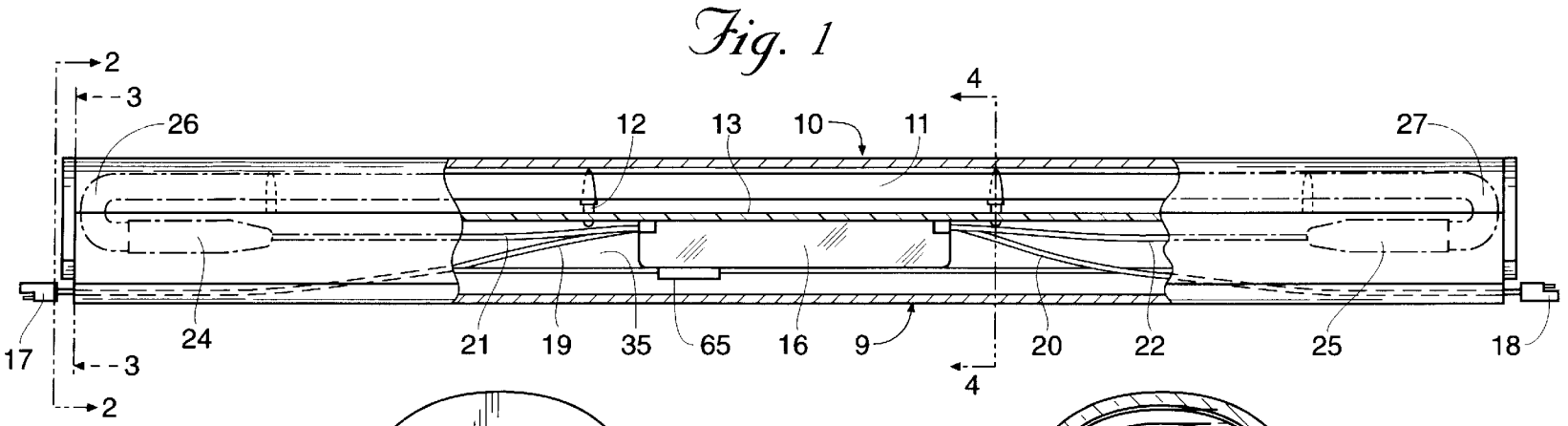
FIG. 1 is a side elevational view of a new neon fixture with a region broken away to show the interior thereof and to show the position of the high voltage supply container.

FIG. 1 introduces some of the major components of the new fixture including a light transparent dome-like longitudinally extending cover member 10 which is generally semi-circular in cross section and covers and protects the neon tube light source 11. The cover can have other configurations as well. The neon tube 11 is supported and constrained on a plurality of tube supports 12 which are anchored in the tube support wall 13 that is essentially the bottom of an inverted channel constituting an intermediate or second housing member 14 whose one sidewall 35 appears in FIG. 1. This figure also reveals the box-like container 16 that contains the encapsulated electronic power supply which will be discussed in connection with other figures.

Fixtures such as the one shown in FIG. 1 may be mounted as individual light sources or they may be mounted end-to-end, for example, and each fixture may be connected to parallel low voltage ac power supply lines that run from fixture-to-fixture. These fixtures are made in various lengths above and below 36 inches. Electrical connectors 17 and 18 for conducting the low voltage electric power lines between fixtures are visible at opposite ends of the fixture in FIG. 1.

Figure 6:
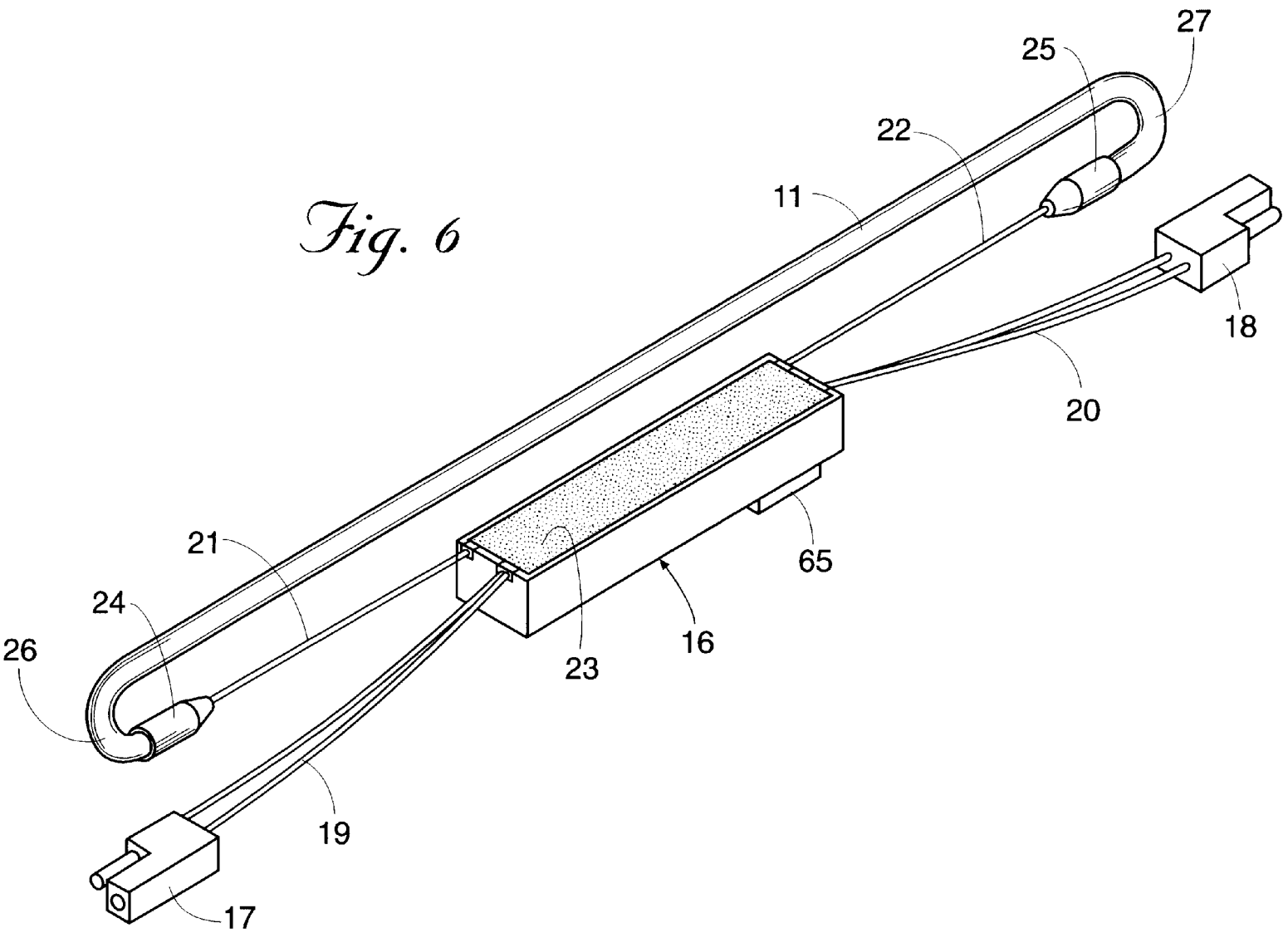
FIG. 6 is a diagrammatic view of the electrical components of the fixture including the neon tube, its high voltage supply lines, the container for the encapsulated high voltage electronic power supply and the leads and connectors which conduct 24 volt alternating current, for example.

Treating the connector 17 at the left end, as the power infeed connector, one may see that it can provide low voltage ac power through a two conductor line 19 to an input of the power supply container 16 and that there is an output to conductor line 20 which connects to connector 18 for providing low voltage alternating current potential to the next adjacent fixture in a series of fixtures. High voltage lines coming out of the power supply container 16 are in the form of single wire insulated conductors 21 and 22. The wiring diagram is demonstrated most clearly in FIG. 6 which shows the power supply container 16 filled with encapsulating dielectric material 23 such as an epoxy resin. Here one may see that the neon tube 11 has insulated connectors 24 and 25 at opposite ends and that the ends are reentrantly bent as indicated at 26 and 27. As shown, the low voltage AC power supply infeed conductors 19 go into the power supply chamber and exit by way of lines 20 to connector 18. The power supply that steps up the 24 volt AC to a higher voltage and frequency is in container 16 so it is not visible through the encapsulating material. The supply has the general characteristics of the one described in U.S. Pat. No. 5,057,748 which is owned by the assignee of the application.

Figure 4:
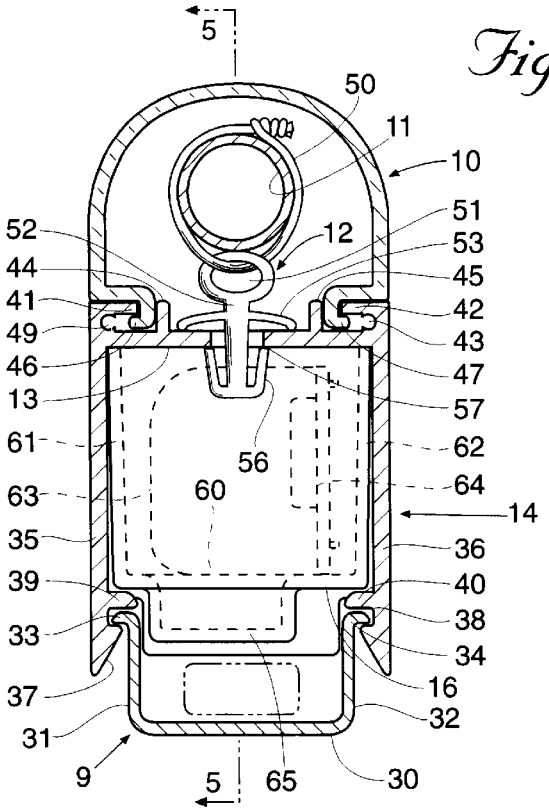
FIG. 4 is a vertical section taken on a line corresponding with the line 4—4 in FIG. 1.

Attention is now invited to FIG. 4 which shows in section the metal base member and first member of the housing which is essentially a building mounting and electrical conductor raceway designated generally by the reference numeral 9. An intermediate housing member, called the second housing member, is designated generally by the numeral 14 and the lens or cover member which is transparent or translucent to light and exhibits generally a semicircular configuration in the depicted embodiment and is designated generally by the numeral 10. The base or raceway 9 is a channel comprised of a part that is arbitrarily called its bottom 30, and has integral spaced apart sidewall members 31 and 32. The longitudinal length of the base channel 9 may be just about co-extensive with the length of a fixture or it can continue from one fixture to another in a series without interruption. The upper edges or rims of the sidewalls 31 and 32 terminate in laterally extending tongues 33 and 34 which are co-extensive with the length of channel 9 and extend in opposite lateral directions. Except for the raceway or the base channel member 9 in FIG. 4 all other components of the fixture are assembled as a unit in the factory and are interlocked to the base channel member 9 in the field by simply pressing intermediate housing member 14 onto the base channel or raceway 9 as will be elaborated later.

Intermediate second housing member 14 is comprised of previously mentioned tube support wall 13 joined integrally with laterally spaced apart sidewalls 35 and 36. The free end margin of typical sidewall 36 is beveled as at 37 and defines a notch 38. To assemble the second housing member 14 to base member channel 9 it is only necessary to set the beveled surfaces 37 of the sidewalls 35 and 36 on the edges of the tongues 33 and 34 of the base member 9 and press such as to cause the sidewalls 35 and 36 to deflect apart sufficiently to pass the ends of the tongues 33 and 34 and allow the tongues to register in the notches 38 whereupon the inherent resiliency of the sidewalls 35 and 36 effects an interlocking grip on the tongues with a snap action. The sidewalls are prevented from bypassing the tongues 33 and 34 when the second member 14 is being pressed onto the first base member 9 by means of stop ledges 39 and 40 formed on sidewalls 35 and 36 abutting the tongues 33 and 34 on the rims of base member 9. In an actual embodiment of the fixture, the channel 9 first housing member is composed of metal, preferably aluminum, and the second housing member 14 is preferably composed of opaque polycarbonate resin. Cover 10 is preferably clear or colored transparent or translucent polycarbonate resin.

The sidewalls 35 and 36 and second housing member 14 continue beyond the plane of tube support wall 13 and terminate in ledges 41 and 42 which are directed toward each other to thereby define small generally L-shaped grooves such as the one which terminate in circular grooves 43 and 49. Ledges 44 and 45 are molded unitarily with neon tube support wall 13 and are co-extensive with the length of second housing member 14. The light transmitting cover 10, which is the third major component of the housing terminates in hook-like tongue elements 46 and 47 which are actually slides. By that is meant the hook-like elements 46 and 47 serve as slides for sliding into grooves 43 and 49. In other words, at the factory, the hook-like elements 46 and 47 engage cover member 10 with second housing member 14 by sliding the hooks 46 and 47 into the grooves 43 and 49 endwise. The parts interfit in such manner that it is impossible to take the cover member 10 off the second member 14 by any means other than sliding one of the those components longitudinally relative to the other.

Neon tube 11 is secured in place with a wire 50 that twists around the tube 11 after having passed through the eye 51 or after having been wrapped around the neck 52 of tube support 12. The tube support 12 comprises flexible arms such as the one marked 53 and a pair of resilient legs 56 which provide for legs 56 to be forced through a hole 57 in tube support wall 13 whereupon the legs, being resilient plastic, spring outwardly to lock the tube support 12 to the wall 13 of second housing member 14.

The power supply container 16 which resides within the confines of walls 35 and 36 of second or intermediate housing member 14 and is shown in hidden lines to be comprised of a bottom wall 60 and laterally spaced apart sidewalls 61 and 62 to provide a trough-like container with closed bottom side and end walls and an open top as viewed in FIG. 4. The electronic power supply is shown in hidden lines in that figure and is designated generally by the reference numeral 63. A circuit board 64 is mounted to the power supply although the electronic components that are mounted to the circuit board and the connection for the incoming and outgoing low voltage AC power supply wires 19 and 20 are not shown. The sidewalls 61 and 62 of power supply container 16 together with bottom wall 60 define an open cavity which is filled with dielectric encapsulating materials such as epoxy resin 23 as was previously pointed out in reference to FIG. 6. There is a small pocket formed integral with the chamber 16 that houses the power supply. Its end configuration 65 is visible in FIG. 4 and its profile is visible in FIG. 1. This is for accommodating a correspondingly configured part, not evident in the drawing, and is not made any larger than it must be to accommodate the power supply. It will be noted that the power supply container 16 is supported in second housing member 14 on the ledges 39 and 40 which project toward each other from the sidewalls 35 and 36 of second housing member 14 and retained therein.

Figure 2:
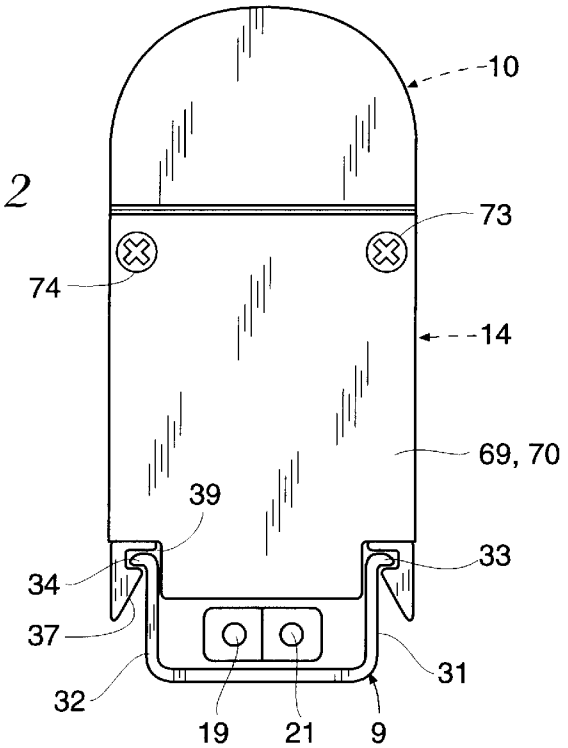
FIG. 2 is an end elevational view of an assembled illustrative fixture taken on a line corresponding to the line 2—2 in FIG. 1 viewed in the direction of the arrows.
Figure 3:
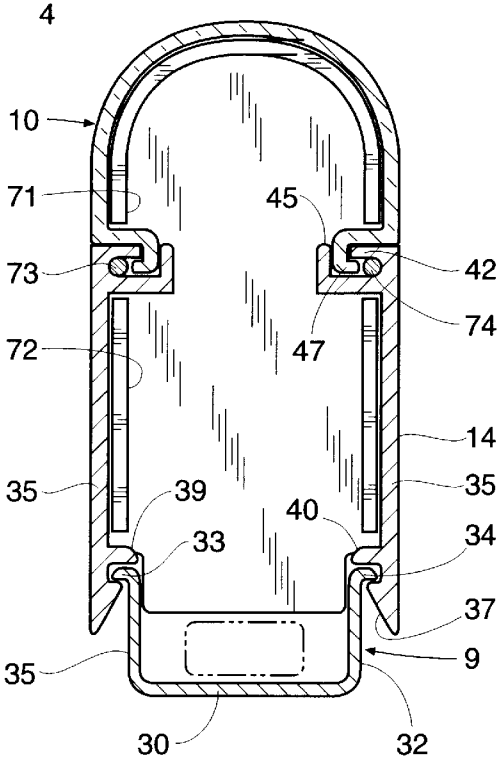
FIG. 3 is a vertical section through the fixture on a line corresponding with the line 3—3 in FIG. 1.
Figure 5:
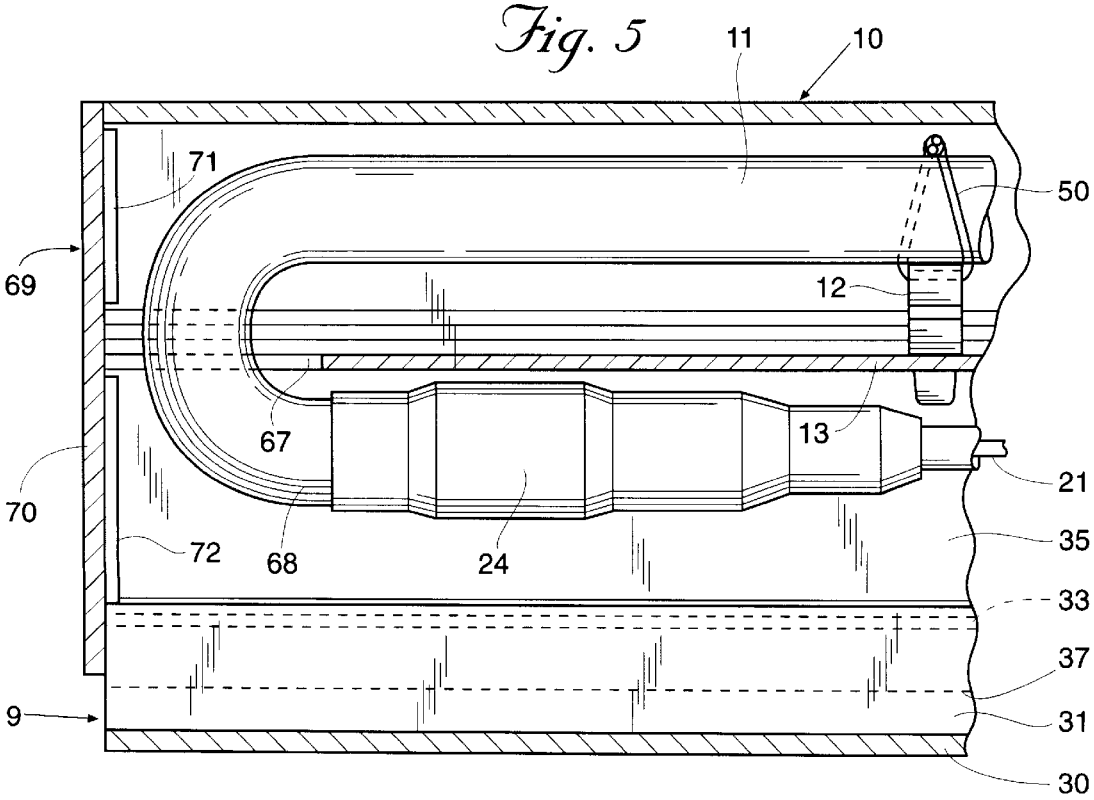
FIG. 5 is a side elevational fragmentary end region view of the fixture.

FIG. 5 shows how the top wall 13 of second housing member 14 has a slot 67 in its end to provide for getting the reentrant end portion 68 of the neon tube directed beneath the wall 13. As is evident in FIG. 5 and other figures, the ends of the housing assembly are closed with cap members such as the one that is identified generally by the numeral 69. As shown end cap 69 has a facing portion 70 and is provided with axially inwardly extending ribs such as those marked 71 and 72 in FIG. 3. The ribs extend into the ends of the second and third or cover member 14 and 10 and assist in aligning the cover member with the housing members. FIG. 2 shows a face view of the end cap 69. The cap 69 is secured to the housing part by means of a pair of screws 73 and 74. The round portions for the grooves that receive these screws were exemplified by the round portions 43 and 49 of the slide grooves in FIG. 1. The round portions 43 and 49 of the grooves are depicted again in FIG. 3 and are shown with the threaded shank of the screw 73 turned into a round groove hole in self-tapping fashion to secure the cover to the housing member.

We claim:

1. A fixture utilizing glass tubing containing a medium that luminesces when electrically excited including:

a first member comprised of laterally spaced apart longitudinally extending side walls and a bottom wall defining a channel for being fixedly mounted, the channel having an open side presented in one direction and the side walls having rims, respectively, extending along the channel, a second member comprised of a longitudinally extending support wall having one side for mounting the glass tubing and an opposite side from which laterally spaced apart longitudinally extending side walls project to define with said support wall a channel having an open side and a space between the side walls, elements on the side walls of the first member and on the side walls of the second member cooperating to interlock said first and second members such that said open side of said second member is presented in a direction opposite of said one direction so the open sides of the first and second members face each other, laterally spaced apart interlock elements formed integrally with and on said opposite side of the support wall of the second member and extending longitudinally thereof and having a defined cross-sectional configuration, a cover member composed of light transmitting material for covering a glass tubing mounted to said opposite of said support wall of the second member, said cover member having longitudinally extending and laterally spaced apart side walls and marginal edges on which there are interlock elements having a cross-sectional configuration complementing said defined cross-sectional to provide for mutual engagement of the interlock elements on the second member and cover member to couple the last named members together, and a power supply assembly operative to apply a potential to said tubing to excite said medium, the power supply assembly being disposed in said space between the side walls of said second member and including elements on the last named side walls on which said assembly is supported.

2. A fixture according to claim 1 wherein the interlock elements on said second member and said interlock elements on said cover member are configured such that the interlock elements on one member can only interlock with the other interlock element on the other member by sliding the interlocks on one endwise and longitudinally of the interlock elements of the other.

3. A fixture according to claim 1 wherein the interlock elements on said support wall of said second member are track elements having longitudinally extending open-ended grooves that are generally L-shaped in cross-sectional configuration and the interlock elements on the cover member are generally L-shaped slides that are only registrable in interlocked condition with the grooves by inserting the slide into the open ends of the grooves.

4. A fixture according to claim 1 wherein said power supply assembly includes a container having an nominally bottom wall, laterally spaced apart side walls, longitudinally spaced apart end walls and a nominally top opening, a power supply disposed in said container having low voltage alternating current input means for being connected to a corresponding alternating current supply having relatively higher voltage output means for being connected to said tubing.

5. A fixture according to claim 1 wherein the low alternating input voltage is substantially 24 volts.

6. A fixture according to claim 4 wherein said container occupied by the power supply is filled with resin.

7. A fixture according to claim 1 wherein:

said rims of said side walls of the first member are shaped as tongues projecting in laterally opposite directions away from each other and extending longitudinally along said open side of said channel, said side walls of the second member respectively terminate with beveled surfaces, adjacent slots and stop elements arranged in the stated order such that to interlock the second member to the first member the beveled surfaces are pressed against said rims of the first member to diverge the side walls of the second member to provide for the rims to enter the notches and the stops to prevent the rims being passed.

* * * * *